US006012699A

United States Patent [19]

Wu et al.

[11] Patent Number: 6,012,699

[45] Date of Patent: Jan. 11, 2000

[54] CONCRETE FORM HAVING ADJUSTABLE CURVATURE

[76] Inventors: Edward Wu, 3F52 L81 Mingtsu Street, Yungho, Taiwan, 23454; James J. Johnson, 9617 Monroe Ct., Urbandale, Iowa 50322

[21] Appl. No.: 08/897,904

[22] Filed: Jul. 21, 1997

[51] Int. Cl.[7] ..... E04G 11/08

[52] U.S. Cl. ..... 249/189; 249/33

[58] Field of Search ..... 249/189, 194, 249/195, 18, 33

[56] References Cited

U.S. PATENT DOCUMENTS

| | | | |
|---|---|---|---|
| 2,436,543 | 2/1948 | Blaski | 108/1 |
| 2,616,148 | 11/1952 | Hawes | 25/131.5 |
| 2,933,056 | 4/1960 | Martin | 108/13 |
| 3,971,176 | 7/1976 | Rannels | 52/86 |
| 4,679,763 | 7/1987 | Brotherton | 249/189 |
| 4,915,345 | 4/1990 | Lehmann | 249/18 |
| 5,137,251 | 8/1992 | Jennings | 249/189 |
| 5,590,493 | 1/1997 | Wilson | 249/189 |

*Primary Examiner*—Michael Safavi

*Attorney, Agent, or Firm*—Kent A. Herink, Esq.; Davis, Brown, Koehn, Shors & Roberts, P.C.

[57] ABSTRACT

A metal form has a flexible panel member with a perimetral flange projected laterally from one side thereof. Each of a pair of transversely opposite side sections of the flange is segmented by a plurality of longitudinally spaced V-shaped notches having their apices adjacent the one side of the panel member to provide for a lateral flexing movement of the panel member to a preselected shape. With the panel member in the predetermined shape, the segments in each of the flange side sections are connected together against relative movement to retain the predetermined shape of the panel member. In a preferred embodiment, each flange segment is connected to an adjacent flange segment by a flexible metal strap.

5 Claims, 3 Drawing Sheets

23A
19a
19
10
11
19b
16
19
21
22
19
12
19a
24
26b
27
18
18
18
14
13
18
23
23B
14
23A
17
22
27
24
21

CONCRETE FORM HAVING ADJUSTABLE CURVATURE

BACKGROUND OF THE INVENTION

Concrete construction forms are generally prefabricated by the manufacturer for use in a particular structural application such as corner forms, linear wall forms, or form parts for assembly on the job to build structures having a curved surface and the like. Thus, in U.S. Pat. No. 2,616,148, a form assembly enables the casting of generally curved surfaces to a particular desired curvature by the use of flexible metal sheets arranged with their side portions in an overlapping relation and having reinforcing members at such side portions that are adjustably clamped to a supporting scaffold to secure the flexible sheets in the desired curved pattern to form an arched roof. Arched roof constructions are also shown in U.S. Pat. Nos. 2,436,543 and 2,933,056. U.S. Pat. No. 3,971,176 discloses a permanently formed wooden stud-truss that has a curved central arch section positioned between a pair of straight end sections. The central arch has transverse slots or notches the sides of which are moved into contact engagement to provide the desired curvature. Before being closed the slots are filled with an adhesive compound to maintain the central arch in permanent deflection.

A concrete form including a flexible panel having an adjustable curvature is described in U.S. Pat. No. 4,679,763. The concrete form is flexible to conform to any desired curvilinear shape having no radius of curvature less than the design limitations of the form. A strap or tension member substantially coextensive with the length of the form and including a plurality of elongated openings is used in association with a plurality of nut and bolt combinations to hold the form in the desired curvilinear shape. Because the single strap extended the entire length of the form, the elongated openings became quite extended at the side edges of the form. Due to the length of the form and the relatively small radii of curvatures to which the flexible form could be made to conform, a single strap could not function for both positive and negative radii of curvatures. This prior art form, accordingly, required two straps, only one of which was used in any given structure of form work. A flexible concrete form that would reduce the number of loose parts and simplify use of the form is desired.

SUMMARY OF THE INVENTION

The invention provides a concrete metal form that is transportable as a unit and may be adjusted for use in the construction of concrete structures having either planar or curvilinear surfaces, or a combination of such surfaces. The form is easily and quickly convertible on the job for such applications to appreciably reduce manufacturing, handling and storage costs by the elimination of a plurality of special job forms. The form has a flexible metal panel member with an integral perimetral flange and ribs projected laterally from one side. A pair of transversely opposite side sections of the perimetral flange are divided into a plurality of segments by longitudinally spaced V-shape notches the apices of which are adjacent the one side of the panel member, to provide for a lateral flexing movement of the panel member to a desired curved shape. This desired shape may obtained, for example, by placing the form on a fixture or jig with the opposite side of the panel member against a predetermined curved surface on the fixture. With the panel member flexed against the curved surface, the segments in each of the flange sections are rigidly but releasably connected together against relative movement by a plurality of retaining or tension strap segments that have a first end portion fixed to a corresponding one of the plurality of the flange segments and an opposite, free end portion that extends laterally to an adjacent flange section. Nut and bolt combinations are used to hold the free end portion of the strap segments to maintain the predetermined curved shape of the flexed panel member. The form is then removed from the fixture for use. As a result of the notch separation of the flange segments and the releasable connection of the segments to hold a predetermined curved shape of the panel member, the form may be readily converted from a curvilinear shape to a planar shape, and vice versa, or to a combination of such shapes as dictated by the job requirements.

DESCRIPTION OF A PREFERRED EMBODIMENT

Figure 1:
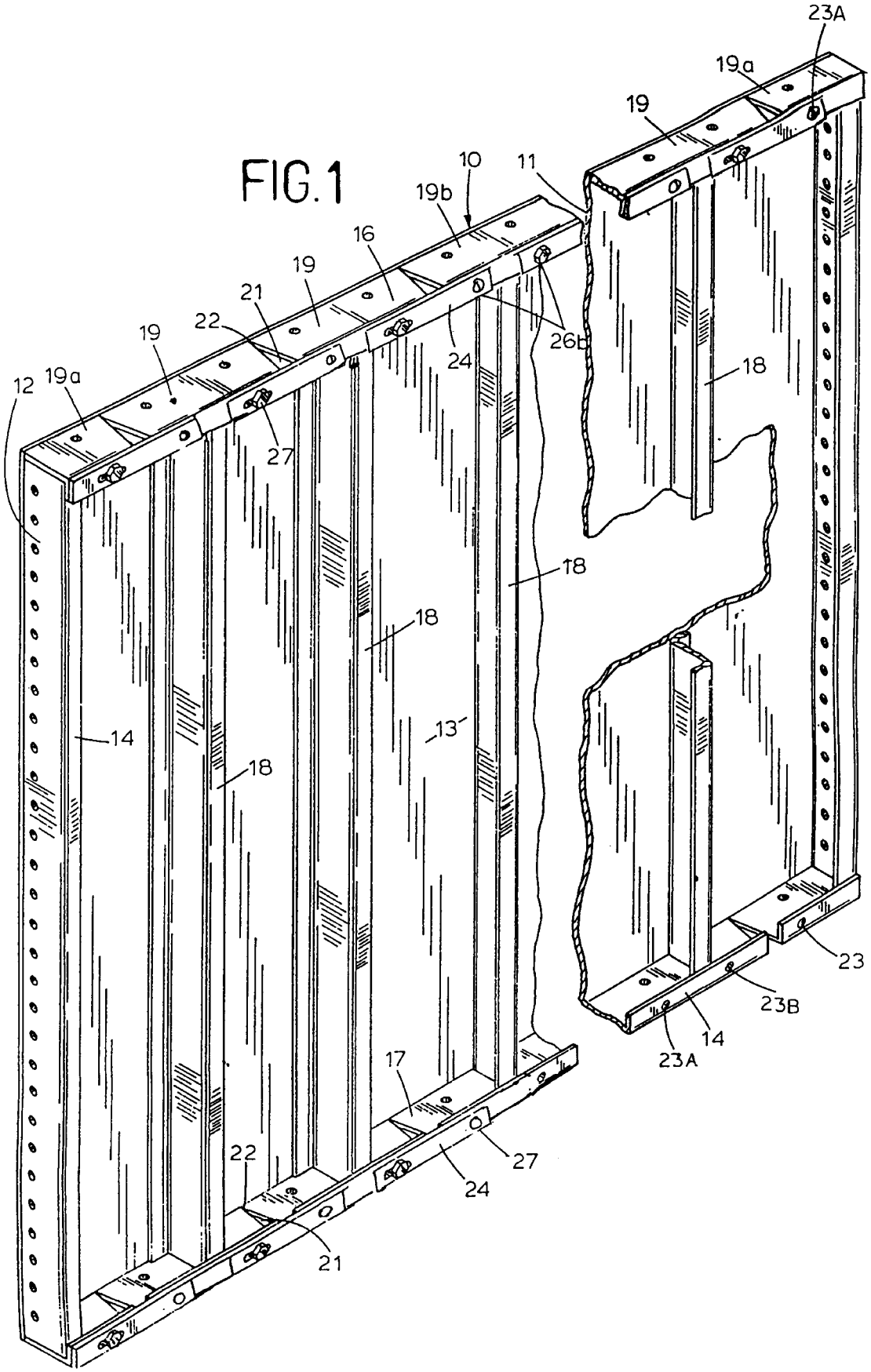
FIG. 1 is foreshortened rear perspective view of the metal concrete form of this invention, with parts removed for clarity, showing its use for forming a concrete structure having a planar surface.
Figure 2:
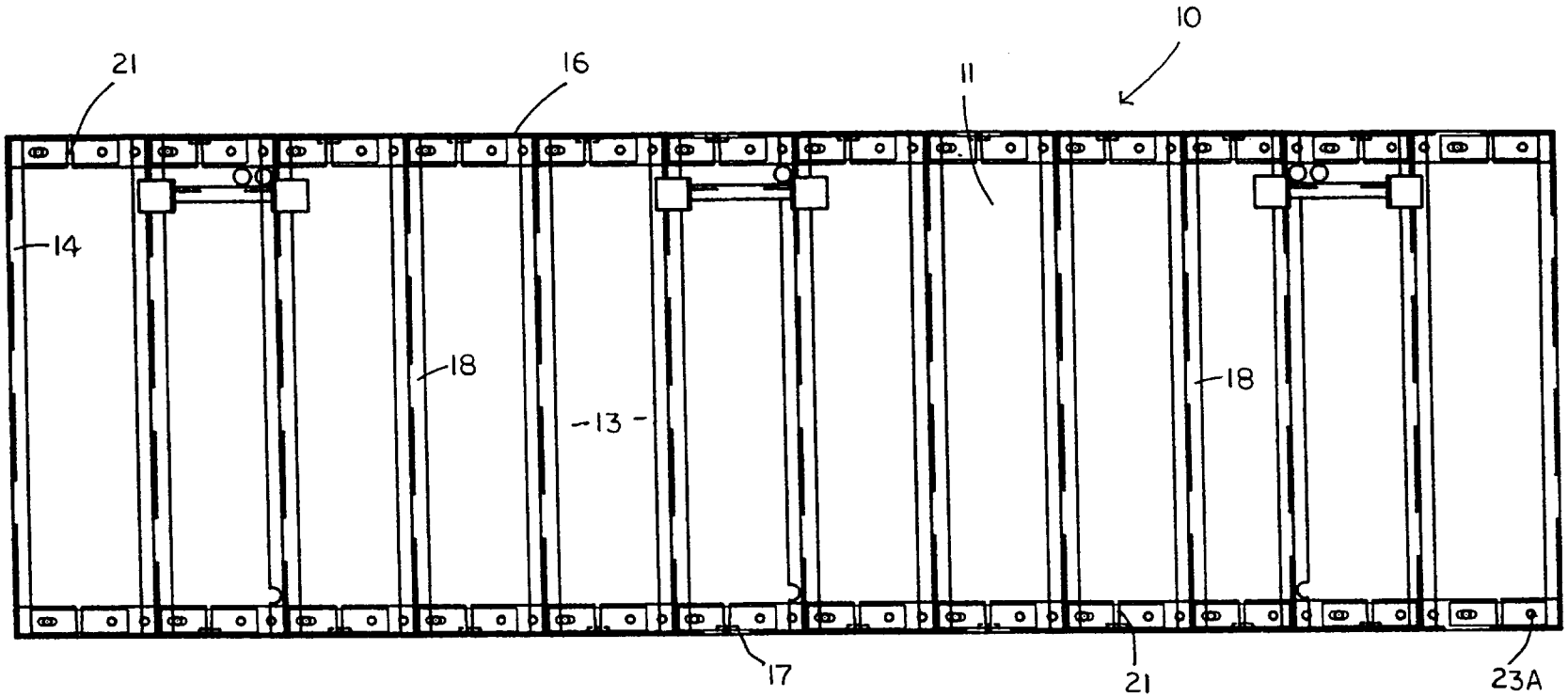
FIG. 2 is a rear elevational view of the concrete form of FIG. 1.

Referring to FIGS. 1 and 2 of the drawings, there is shown a metal concrete form 10 of a generally pan shape having a panel member 11 with a perimetral flange 12 projected laterally from one side 13 thereof. The flange 12 has a terminal flat surface portion or projection 14 in a parallel relation with the panel member 11. Spaced longitudinally of a pair of transversely opposite side sections 16 and 17 of the flange 12 and extended therebetween in a parallel spaced relation are a plurality of brace members 18 each of which is secured as by weldments to the one side 13 of the panel member 11. As shown in FIG. 1, each brace member is of a height substantially equal to the height of the flange 12 with its opposite ends underlying the terminal projections 14 on the flange side sections 16 and 17.

For the purpose of converting the form 10 to on-site use in the construction of concrete structures having either planar or curvilinear surfaces, each of the side flange sections 16 and 17 is divided into a plurality of segments 19 by V-shape notches 21 having their apices 22 adjacent the side 13 of the panel member 11 and each of which is located between adjacent brace members 18. A first of the end segments 19*a* is formed with a single, round hole 23*a*, a second, opposite of the end segments 19*a* is formed with a single, round hole 23*b*, and each remaining segment 19 with a pair of longitudinally spaced, round holes 23*a* and 23*b*.

Figure 3:
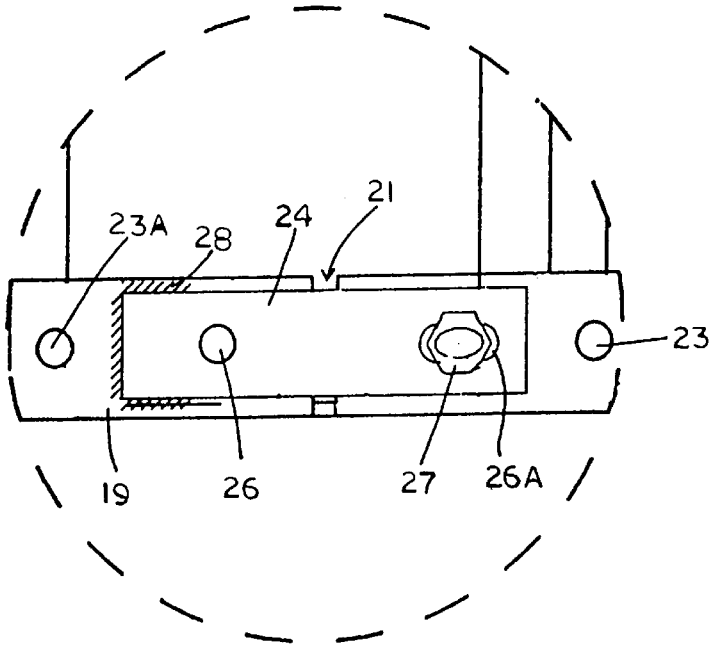
FIG. 3 is an enlarged detail view of the metal concrete form in FIG. 1 showing the assembly relation of a tension member with the panel member of the form.
Figure 4:
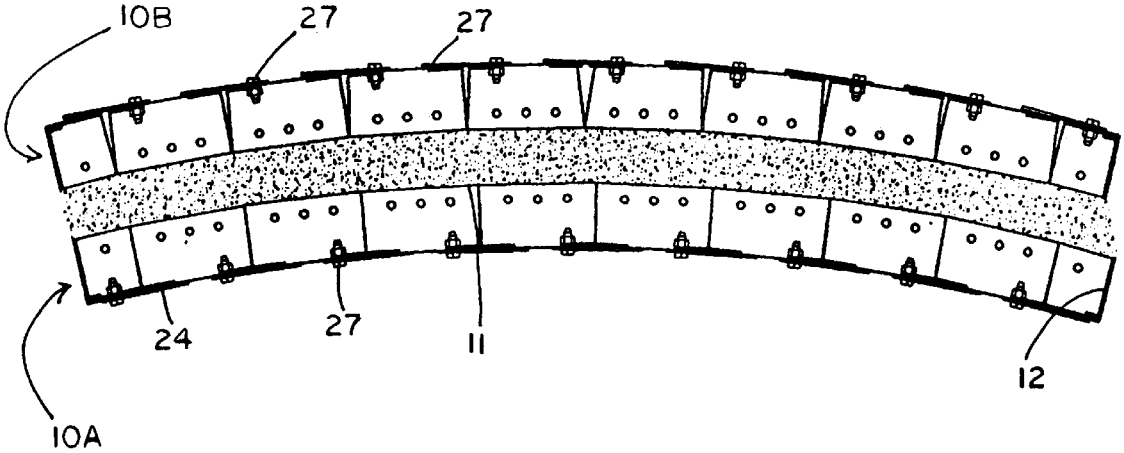
FIG. 4 is a top view illustrating the use of a pair of the metal concrete forms to build a wall structure having a curvilinear surface.

The panel member 11 is formed from a sheet steel material so as to be bendable laterally of the form 10 at the notches 21 from the planar position illustrated in FIG. 1 to the reversely curved positions illustrated in FIG. 4. The planar shape of the panel member 11 in FIG. 1, in the construction of concrete structures having planar surfaces, is maintained by a plurality of tension or flat strap segments 24 formed with a round opening 26*a* adjacent a first end portion of the strap segments 24 and an elongated opening 26*b* adjacent a second end portion of the strap segments 24 for alignment with associated holes 23*a* and 23*b,* respectively, in the segments 19 and 19*a* of the flange sections 16 and 17. In the manufacture of the panel member 11, the first end portion of the strap segments 24 are initially attached to the segments 19 and 19*a* by bolt assemblies 27 insertable through the aligned ones of the round holes 23*a* and openings 26*a*. The strap segments 24 are then fixed as by weldments 28 (FIG. 3) or the like to the respective flange sections 19 and 19*a,* whereupon the bolt assembly may be removed. Upon being fixed at the flange segments 19 and 19*a,* the second, free end portion of the strap segments extends over an adjacent one of the flange segments 19 and 19*a* with the corresponding opening 26*b* centrally aligned with the elongated hole 23*b*. Bolt assemblies 27 insertable through the aligned ones of the round holes 23*b* and elongated openings 26*b* on being tightened lock the segments 19 and 19*a* in each flange section against relative movement whereby to maintain the planar adjustment of the panel member 11.

When the form 10 is to be used to build a concrete structure having a curvilinear surface, each of the tension strap segments 24 is released from its flange segment locking position by loosening of the bolt assemblies 27 to provide for its repositioning with respect to the flange sections 16 and 17. To curve the panel member 11 generally convexly, as illustrated for the form 10*a* in FIG. 4, the form, with the tension strap segments 24 released, is flexed to the desired shape, for example by placing it against a form or fixture, normally of a wooden construction, and having a predetermined generally concave surface. In one embodiment of the invention, the sheet metal forming the panel member 11 and the perimetral flange 12 have a thickness of about 3/16 inch. The brace members 18 are also formed from a 3/16 inch sheet metal material so that the form 10 has an average weight of about twenty pounds per square foot. This weight is generally sufficient to conform the panel member 11 to a supporting curved surface without the application of any additional weight or pressure.

With the form 10 thus positioned on the fixture, the bolt assemblies 27 at the elongated holes 26*b* in the strap segments 24 are tightened. Following this initial adjustment of the bolt assemblies, all of the bolt assemblies are then torqued uniformly to about two hundred foot pounds. By virtue of the elongated shape of the openings 26*b* in the tension strap segments 24, movement of the tension member relative to the bolt assemblies fixed in the holes 23 in the flange section 16 and 17, is permitted to accommodate the curvilinear shape of the panel member 11.

In the adjustment of the form 10 to its curved shape shown in FIG. 3 at 10*b,* the procedure is similar to that followed in the curvilinear shaping of the form 10*a*. In this respect the fixture has a predetermined curved surface of a generally convex shape. With the tension member 24 relaxed, relative to the flange side sections 16 and 17, the form 10 is placed against the fixture. Similarly to the procedure described above, the center bolt assemblies 27 are initially tightened, after which the bolt assemblies to each side thereof are alternately tightened and then finally uniformly torqued to about two hundred foot pounds.

It is seen, therefore, that in adjusting the form 10 for planar surface structures, the bolt assemblies 27 are positioned substantially centrally of the elongated openings 26 in the tension member 24 (FIG. 2) and that when the panel member 11 is adjusted to curvilinear reverse positions thereof, the bolt assemblies 27 are at one or the other of the ends of the longitudinal openings 26 (FIG. 4). The radius of a curvilinear surface will be limited by the contact engagement of opposite side portions of the notches 21 which are of a size to permit generation of predetermined curved surfaces about radii of twenty feet and greater. It is apparent that to convert the form 10 from a curvilinear shape to a planar shape the tension member 24 is relaxed and the panel member positioned against an available flat surface, after which the tension member is rigidly secured to the flange side sections 16 and 17. Although a metal concrete form has been described in detail, it is to be understood that the invention is equally applicable to a fiberglass form or to a wooden form wherein the panel members are bendable and the perimetral flange thereon is notched and then tensioned to a desired shape by a plurality of strap or tension members 24.

Although the invention has been described with respect to a preferred embodiment thereof, it is to be understood that it is not to be so limited since changes and modifications can be made therein which are within the full intended scope of this invention as defined by the appended claims.

I claim:

1. A concrete form having a flexible panel member with an upstanding perimetral flange projected laterally from one side thereof and wherein said flange has a pair of transversely opposite side sections disposed on opposite ends of said form each of which side sections has a flat terminal surface portion extended inwardly in a direction parallel to said one side of the form, the improvement comprising:

(a) each of said opposite flange side sections is divided into a plurality of segments by a plurality of notches longitudinally spaced over the length thereof, with each notch terminating in a V-shape portion having the apex thereof adjacent said one side of the panel member whereby said panel member is laterally flexibly movable to a preselected generally curve shape, and (b) a plurality of bendable metal strap segments for adjustably interconnecting the terminal surface portions of a corresponding pair of said flange segments to maintain the pre-selected curved shape of said panel, said metal strap segments aligned end-to-end in at least one row substantially parallel to said terminal portions of said side sections of said flange section segments, and said metal strap segments positioned back to back against the terminal surface portion of said flange segments.

2. The concrete form according to claim 1, wherein each of said strap segments includes a first end portion fixed to a first of said flange sections and a second, opposite end portion that is releasably secured to a second flange section at an adjustable position whereby the first flange section is held in a fixed position relative to said second flange section.

3. The concrete form according to claim 1, wherein said bendable metal strap segments span each of said notches.

4. The invention in accordance with claim 1 wherein each of said metal strap segments has a first end and a second end wherein said first end interconnects with said terminal surface portion of a first of said corresponding pair of flange segments such that said metal strap remains substantially stationary relative to said terminal surface portion of said first flange segment, and said second end of said metal strap interconnects with said terminal surface portion of a second of said corresponding pair of flange segments such that said metal strap is movable relative to said terminal surface portion of said second flange segment.

5. A concrete form having a flexible panel member with an upstanding perimetral flange projected laterally from one side thereof and wherein said flange has a pair of transversely opposite side sections disposed on opposite ends of said form each of which has a terminal portion, projected inwardly in a direction parallel to said one side of the form, the improvement wherein:

(a) each of said opposite flange side sections is divided into a plurality of segments by a plurality of notches longitudinally spaced over the length thereof, with each notch terminating in a V-shape portion having the apex thereof adjacent said one side of the panel member whereby said panel member is laterally flexibly movable to a preselected generally curve shape;

(b) a plurality of bendable metal strap segments one for each of said opposite flange said sections aligned end-to-end in at least one row substantially parallel to said terminal portions of said side sections of said flange section segments and said metal strap segments positioned back to back against the terminal portions of said flange section segments;

(c) with each segment of each of said opposite flange sections having longitudinally spaced round holes in the terminal portion thereof, and each of said metal strap segments having a first end portion fixed to a corresponding one of said flange section and second end portion including an elongated hole alignable with a hole in said terminal portions of another of said flange segments; and (d) bolt means extendible through associated holes in said terminal portions and in said strap segments for retaining the panel in the preselected curved shape.

* * * * *